US009941672B2

(12) United States Patent
Stifel et al.

(10) Patent No.: US 9,941,672 B2
(45) Date of Patent: Apr. 10, 2018

(54) CORONA IGNITION DEVICE AND METHOD FOR THE PRODUCTION THEREOF

(71) Applicant: BorgWarner Ludwigsburg GmbH, Ludwigsburg (DE)

(72) Inventors: Timo Stifel, Stuttgart (DE); Johannes Hasenkamp, Ditzingen (DE); Alexander Schenk, Waiblingen (DE); Martin Allgaier, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 15/357,556

(22) Filed: Nov. 21, 2016

(65) Prior Publication Data

US 2017/0149216 A1 May 25, 2017

(30) Foreign Application Priority Data

Nov. 23, 2015 (DE) ..... 10 2015 120 254

(51) Int. Cl.

| | |
|---|---|
| ***H01T 19/00*** | (2006.01) |
| ***H01T 13/00*** | (2006.01) |
| ***H01T 19/04*** | (2006.01) |
| ***H01T 13/20*** | (2006.01) |
| ***H01T 13/50*** | (2006.01) |

(52) U.S. Cl.

CPC ..... *H01T 19/04* (2013.01); *H01T 13/20* (2013.01); *H01T 13/50* (2013.01)

(58) Field of Classification Search

USPC ..... 250/324, 423 R, 426, 526; 313/118, 138, 313/141–143; 123/143 A, 143 B, 142 R, 123/169 EL, 169 R, 594, 596, 606, 608

See application file for complete search history.

(56) References Cited

U.S. PATENT DOCUMENTS

| | | | | |
|---|---|---|---|---|
| 7,741,761 | B2 * | 6/2010 | Jaffrezic | H01T 13/52 313/141 |
| 8,217,560 | B2 * | 7/2012 | Giffels | H01T 13/20 313/136 |
| 8,226,901 | B2 * | 7/2012 | Makita | F02P 3/01 123/143 B |
| 8,550,048 | B2 * | 10/2013 | Stifel | H01T 13/467 123/143 B |
| 8,614,540 | B2 * | 12/2013 | Braeuchle | H01T 13/50 123/608 |

(Continued)

FOREIGN PATENT DOCUMENTS

| | | |
|---|---|---|
| DE | 10 2009 059 649 A1 | 6/2011 |
| DE | 20 2014 101 756 U1 | 4/2014 |

(Continued)

*Primary Examiner* — Bernard Souw

(74) *Attorney, Agent, or Firm* — Bose McKinney & Evans LLP

(57) ABSTRACT

This disclosure relates to a corona ignition device having: an insulator, which bears an electrically conductive coating, which forms a tubular face; a central electrode, which sits in the insulator and leads to at least one ignition tip; and a holder, in which the insulator sits. According to this disclosure, the insulator has an annular shoulder, on which is situated the end of the tubular face of the coating that faces away from the at least one ignition tip. A method for producing a corona ignition device is also described.

16 Claims, 3 Drawing Sheets

(56) References Cited

U.S. PATENT DOCUMENTS

| | | | | |
|---|---|---|---|---|
| 8,863,730 | B2 * | 10/2014 | Achstaetter | H01T 13/36 123/143 R |
| 2011/0146640 | A1 | 6/2011 | Achstaetter et al. | |
| 2011/0253089 | A1 * | 10/2011 | Braeuchle | H01T 13/50 123/143 B |
| 2013/0199484 | A1 * | 8/2013 | Stifel | H01T 13/467 123/143 B |
| 2014/0123925 | A1 * | 5/2014 | Stifel | F02P 23/04 123/143 B |
| 2015/0114332 | A1 * | 4/2015 | Stifel | F02P 23/04 123/143 B |

FOREIGN PATENT DOCUMENTS

| | | | |
|---|---|---|---|
| DE | 10 2014 111 897 | A1 | 4/2015 |
| EP | 1 515 594 | A2 | 3/2005 |

* cited by examiner

CORONA IGNITION DEVICE AND METHOD FOR THE PRODUCTION THEREOF

RELATED APPLICATIONS

This application claims priority to DE 10 2015 120 254.9, filed on Nov. 23, 2015, which is hereby incorporated herein by reference in its entirety.

BACKGROUND

Corona ignition devices are generally known from EP 1 515 594 A2, DE 20 2014 101 756 U1, and DE 10 2009 059 649, for example.

For corona ignition devices, the dielectric strength of the insulator is of great importance. Bypasses, flashovers and parasitic partial discharges can lead to premature failure of a corona ignition device. The risk of flashovers and parasitic partial discharges can be reduced with an electrically conductive coating of the insulator. Such coatings can consist of metal or electrically conductive ceramic and provide a cavity-free contact face between insulator and electric earth, which reduces susceptibility to flashovers and partial discharges. However, the end of the coating is susceptible to flashovers, since field peaks can form there.

To counteract this problem, it is known from DE 20 2014 101 756 U1 to provide an undercut in the insulator so that the tubular face of the coating is turned over its end. In this way, the end of the coating is situated in a field-free space, namely, inside a space provided by the undercut. In the radial direction the end of the coating is placed above an empty space provided by the undercut and above another section of the coating covering the bottom of the undercut. Therefore, flashovers can be prevented there. However, a disadvantage of this solution is the complicated shape of the insulator, which results in very high manufacturing costs.

SUMMARY

This disclosure teaches a way, in a corona ignition device, to reduce the risk of flashovers at the end of the electrically conductive coating of the insulator with a reasonable manufacturing outlay.

The insulator of a corona ignition device according to this disclosure has an annular shoulder, on which is situated the end of the electrically conductive coating that is remote from the combustion chamber. Any irregularities present on the end of the coating, in particular an irregular boundary, are largely insignificant for the electric field, since the area of electrically conductive coating is oriented radially at the end thereof so that a geometrical tangent extending coating points generally in the radial direction. In the axial direction, the end of the electrically conductive coating that is remote from the combustion chamber is well-defined and therefore the risk of flashovers is also correspondingly reduced. The end remote from the combustion chamber is the end that is further away from the at least one ignition tip than the other end.

The end of the electrically conductive coating is a ring-shaped line where a first surface of the insulator that is free from the electrically conductive coating borders on a second surface of the insulator that is covered by the electrically conductive coating. For example, a tubular section of the insulator that is free from the electrically conductive coating may border on a groove which is covered with the coating. One sidewall of the groove provides a shoulder, on which the end of the coating is arranged.

The annular shoulder may have an annular face that faces towards the at least one ignition tip and on which the end of the coating is situated. The tubular face of the coating is therefore widened at the end thereof, i.e., a tangential extension of the coating is oriented radially outwards.

A corona ignition device according to this disclosure can be produced with a method in which: an insulator having an annular shoulder is formed; a first section of the insulator that ends at the annular shoulder is provided with an electrically conductive coating, at least some of the annular face of the annular shoulder also being coated; a central electrode is inserted into the insulator; and the insulator is inserted into a holder such that the electrically conductive coating bears against the holder. With such a method it is not necessary to carry out the steps in exactly the same order as just stated. For example, the coating can be applied before or after the central electrode is inserted into the insulator.

In an advantageous refinement of this disclosure, the coating is applied continuously on both sides of the annular shoulder and then a section of the insulator that is remote from the combustion chamber is removed, for example, ground away, as far as the annular shoulder. In this manner, a well-defined end of the coating that largely prevents field peaks can be produced. In this case, the annular shoulder ends at the outer boundary thereof in a ground edge, i.e., an edge formed by grinding the insulator.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
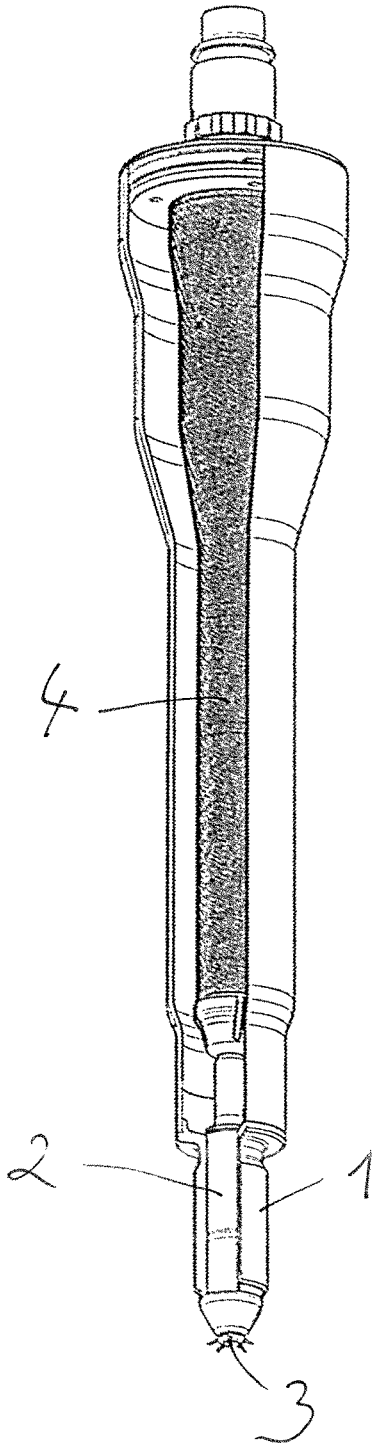
FIG. 1 shows an illustrative embodiment of a corona ignition device.

The corona ignition device shown in FIG. 1 generates a corona discharge in order to ignite fuel in a combustion chamber of an engine. The corona ignition device has a longitudinal axis 8 and an insulator body 2, which is held by a holder 1, for example, consisting of steel. A central electrode 3, which has one or more ignition tips, projects out of the front end of the insulator 2 on the combustion chamber side. One section of the central electrode 3 can be formed from electrically conductive glass, which seals off the duct that runs through the insulator body 2.

The central electrode 3, together with the insulator body 2 and the holder 1, forms a capacitor, which is series-connected to a coil 4 connected to the central electrode 3. The coil 4 consists of wire, which is wound onto a coil body. This capacitor and the coil 4 are part of an electrical oscillating circuit, the excitation of which can be used to generate corona discharges at the ignition tips or ignition tip of the central electrode 3.

In the embodiment shown, the coil 4 is arranged in a metal housing, which is formed by the holder 1 and in which the insulator body 2 sits. The coil 4 may also be arranged outside such a housing and, for example, be connected to the central electrode 3 via a cable.

Figure 2:
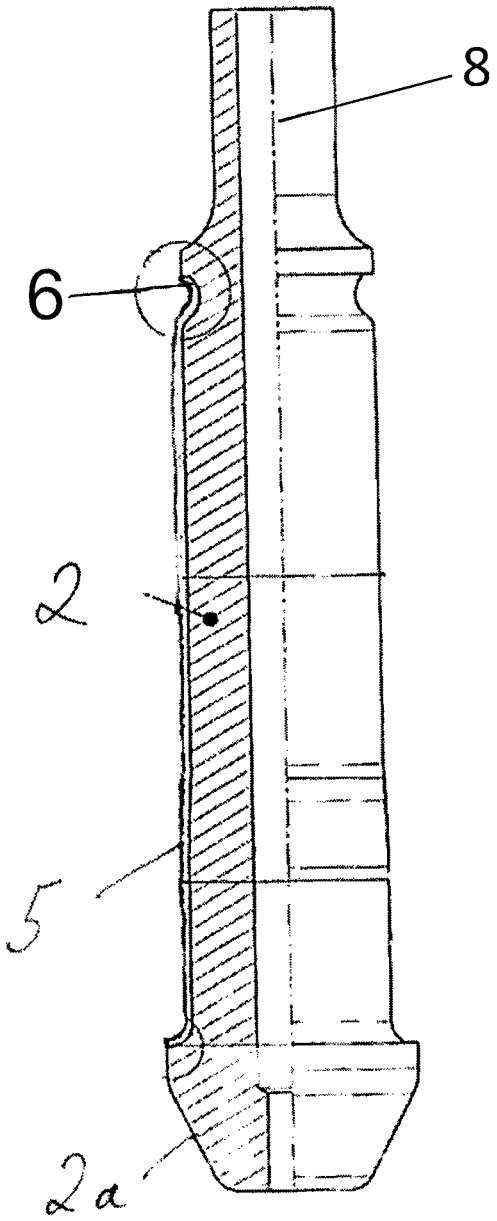
FIG. 2 shows the insulator of the corona ignition device shown in FIG. 1.

The insulator 2 of the corona ignition device is shown schematically in FIG. 2. The insulator 2 bears an electrically conductive coating 5, which is shown with exaggerated thickness in FIG. 2 for the sake of clarity. The coating 5 can consist of metal or electrically conductive ceramic, for example ceramic based on titanium nitride and/or chromium nitride. The insulator 2 has a widened end section 2*a*, which projects out of the holder 1, at an end that faces the at least one ignition tip. Adjoining this preferably uncoated end section 2*a* there is a cylindrical section, which is covered by the coating 5 and against which the holder 1 bears. The holder 1 can hold the insulator 2 in a clamping manner, for example, the insulator 2 can form a press-fit with the holder 1. However, the insulator 2 can also be soldered or adhesively bonded into the holder 1.

The coating 5 forms a tubular face, which ends on an annular shoulder 6. The annular shoulder 6 may be provided by a groove, which can be seen in particular in FIG. 3. The annular shoulder 6 has an annular face facing towards the ignition tip or ignition tips. On this annular face of the annular shoulder 6 is situated the end of the electrically conductive coating 5 that is remote from the combustion chamber, that is, the end facing away from the at least one ignition tip.

The holder 1 can bear against the full length of the cylindrical section covered by the coating 5. This cylindrical section is however preferably somewhat longer. A tapering section 2*b* of the insulator 2 adjoins the cylindrical section. The transition from the annular shoulder 6 to this tapering section is rounded. Field peaks can be reduced in this manner. The annular shoulder 6 has an edge 7 on its outer boundary. The electrically conductive coating 5 preferably ends at this edge of the annular shoulder.

Edge 7 on the outer boundary of the annular shoulder 6 can be a ground edge, that is, the insulator 2 can be ground on the side remote from the combustion chamber, facing away from the at least one ignition tip. Advantageous production is possible by initially applying the electrically conductive coating 5 to the insulator 2 beyond the annular shoulder 6. The coating 5 is then removed, for example by grinding or turning, on the side of the insulator 2 remote from the combustion chamber, thereby forming edge 7. In this manner, the coating terminates such that it is flush with the outside cylindrical surface of the insulator.

Figure 3:
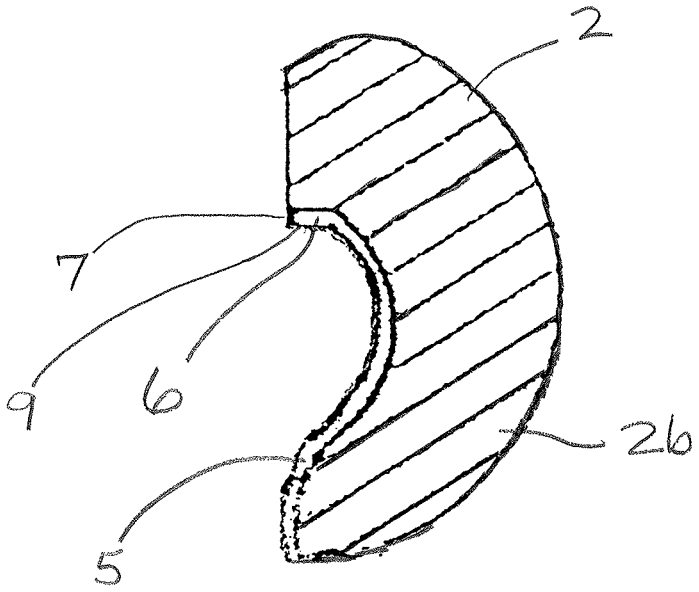
FIG. 3 shows a detail of FIG. 2.

As shown in FIGS. 2 and 3, coating 5 has an end section 9 positioned at the annular shoulder 6 at which the coating 5 terminates. As shown, this end section is oriented substantially radially outward with respect to the longitudinal axis 8 of the corona ignition device. End section 9 forms a ring-shaped line around the insulator which divides the surface of the insulator that is free from the electrically conductive coating 5 from the coated surface. The underside of end section 9 comprises an annular surface which is positioned substantially perpendicular to the longitudinal axis.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Holder
2 Insulator
2*a* End section of insulator
2*b* Tapering insulator section
3 Central electrode
4 Coil
5 Coating
6 Annular shoulder
7 Edge
8 Longitudinal axis
9 End section

What is claimed is:

1. A corona ignition device, comprising:
an insulator which bears an electrically conductive coating, which forms a tubular face;
a central electrode which sits in the insulator and leads to at least one ignition tip; and
a holder in which the insulator sits;
wherein the coating has a first end and a second end, the second end of the coating located further away from the at least one ignition tip than the first end; and
wherein the insulator has an annular shoulder on which is situated the second end of the coating.

2. The corona ignition device according to claim 1, wherein the annular shoulder has an annular face, which faces the at least one ignition tip.

3. The corona ignition device according to claim 1, wherein the annular shoulder has an edge at an outer boundary.

4. The corona ignition device according to claim 3, wherein the coating ends at the edge.

5. The corona ignition device according to claim 3, wherein the edge is a ground edge.

6. The corona ignition device according to claim 1, wherein the electrically conductive coating is formed from ceramic.

7. The corona ignition device according to claim 1, wherein the holder bears against a cylindrical section of the coating.

8. The corona ignition device according to claim 1, wherein the annular shoulder at the radially inner boundary thereof borders via a rounded portion an insulator section that tapers towards the annular shoulder.

9. The corona ignition device according to claim 1, wherein the annular shoulder is formed by a groove in the insulator.

10. The corona ignition device according to claim 1, wherein the end of the coating is an annular surface that is generally perpendicular to an axial direction of the insulator.

11. A corona ignition device, comprising:
a central electrode leading to at least one ignition tip;
an insulator in which the central electrode is disposed, the insulator having an annular shoulder remote from the at least one ignition tip;
a holder in which the insulator is disposed; and
an electrically conductive coating covering a portion of the insulator, the coating having a first end and a second end, the second end of the coating being located further away from the at least one ignition tip than the first end, the second end of the coating being located at the annular shoulder, the coating having an end section at the annular shoulder that is oriented substantially radially outward with respect to a longitudinal axis of the device.

12. The corona ignition device according to claim 11, wherein the end section of the coating is oriented substantially perpendicular to the longitudinal axis.

13. The corona ignition device according to claim 11, wherein the end section of the coating forms a ring-shaped line around the insulator.

14. The corona ignition device of claim 11, wherein the end section of the coating defines an annular surface that is substantially perpendicular to the longitudinal axis.

15. A method for producing a corona ignition device, comprising:

forming an insulator having an annular shoulder, the insulator having a combustion chamber side configured for placement near a combustion chamber;

providing a section of the insulator with an electrically conductive coating, the coating having first and second ends, the second end being further away from the combustion chamber side of the insulator than the first end, wherein the second end of the coating is located at the annular shoulder and the coating covers at least some of an annular face of the annular shoulder;

inserting a central electrode into the insulator; and inserting the insulator into a holder such that the electrically conductive coating bears against the holder.

16. The corona ignition device according to claim 15, wherein the electrically conductive coating is also applied to a second section of the insulator bordering the annular shoulder on a side facing away from the first section, and the coating is subsequently removed from the second section, so that the coating ends at an edge of the annular shoulder.

* * * * *